US006581814B1

(12) United States Patent
Hsu

(10) Patent No.: US 6,581,814 B1
(45) Date of Patent: Jun. 24, 2003

(54) SINGLE/CONTINUOUS DUAL FIRING MODE TRIGGER STRUCTURE FOR AIR NAILING GUN

(75) Inventor: Chu-Chien Hsu, Tali (TW)

(73) Assignee: Nailermate Enterprise Corp., Taichung Hsien (TW)

( * ) Notice: Subject to any disclaimer, the term of this patent is extended or adjusted under 35 U.S.C. 154(b) by 0 days.

(21) Appl. No.: 10/273,586

(22) Filed: Oct. 21, 2002

(30) Foreign Application Priority Data

Dec. 31, 2001 (TW) ..... 90224592 U

(51) Int. Cl.[7] ..... B25C 1/04
(52) U.S. Cl. ..... 227/8; 227/130
(58) Field of Search ..... 227/8, 120, 130, 227/109

(56) References Cited

U.S. PATENT DOCUMENTS 5,551,621 A * 9/1996 Vallee ..... 227/130
5,692,663 A * 12/1997 Yang ..... 227/8
5,791,545 A * 8/1998 Lin ..... 227/130
5,797,533 A * 8/1998 Lee ..... 227/8
5,836,501 A * 11/1998 Lai ..... 227/8
5,862,969 A * 1/1999 Lee ..... 227/130
6,059,161 A * 5/2000 Chang et al. ..... 227/130
6,116,488 A * 9/2000 Lee ..... 227/8
6,199,739 B1 * 3/2001 Mukoyama et al. ..... 227/8
6,205,894 B1 * 3/2001 Tanaka ..... 227/8
6,213,372 B1 * 4/2001 Chen ..... 227/8
6,357,647 B1 * 3/2002 Ou ..... 227/8

* cited by examiner

*Primary Examiner*—Scott A. Smith
(74) *Attorney, Agent, or Firm*—Charles E. Baxley

(57) ABSTRACT

A single/continuous dual firing mode trigger_structure used in an air nailing gun for single/continuous firing control in which a switching mechanism is provided in the trigger and adapted to selectively control the operation of the trigger between a single firing mode and a continuous firing mode.

10 Claims, 7 Drawing Sheets

SINGLE/CONTINUOUS DUAL FIRING MODE TRIGGER STRUCTURE FOR AIR NAILING GUN

BACKGROUND OF THE INVENTION

1. Field of the Invention

The present invention relates to an air nailing gun and, more specifically, to a single/continuous dual firing mode trigger structure for air nailing gun.

2. Description of the Related Art

A regular air nailing gun generally comprises a gun body having muzzle, a firing valve for firing the air nailing gun, a trigger for driving the firing valve to fire the air nailing gun, a supplementary trigger pivoted to the trigger, and a safety link axially slidably mounted in the muzzle. When pressed the trigger accidentally, the supplementary trigger is received inside the trigger without triggering the firing valve. When pressing the safety link against the workpiece after the trigger pressed, the supplementary trigger is forced to trigger the firing valve, thereby causing the firing valve to fire the air nailing gun. This structure of air nailing gun is functional, however the user must repeat the triggering action to fire the air nailing gun when wishing to drive a second nail into the workpiece.

SUMMARY OF THE INVENTION

The present invention has been accomplished under the circumstances in view. It is the main object of the present invention to provide a single/continuous dual firing mode trigger structure for air nailing gun, which provides a single firing mode and a continuous firing mode for selection. To achieve these and other objects of the present invention, the single/continuous dual firing mode trigger structure installed in an air nailing gun and adapted to fire said nailing gun, comprising: a gun body having a handle; a firing valve installed in the handle, the firing valve being of a two-step firing design that does not fire said air nailing gun when forced to a first step position, and achieves a firing action when forced further to a second step position; a trigger holder fixedly provided in the handle, the trigger holder having a pivot hole; a safety link axially slidably mounted in muzzle of the gun body, the safety link having a curved rear end extended to the inside of the trigger holder; and a trigger assembly pivoted to the pivot hole of the trigger holder and controlled by the safety link to drive the firing valve to fire the air nailing gun. The trigger assembly comprises a main trigger member pivoted to the pivot hole of the trigger holder, a pivot shaft, which pivots he main trigger member to the pivot hole of the trigger holder, the pivot shaft having a longitudinal cut plane, and a supplementary trigger member, the supplementary trigger member having a tail movably pivoted to the inside of the main trigger member and a head to be stopped at the pivot shaft. The pivot shaft can be rotated to move the longitudinal cut plane between two positions within 90° angle relative to the supplementary trigger member to control the air nailing gun between the single firing mode and the continuous firing mode.

DETAILED DESCRIPTION OF THE PREFERRED EMBODIMENT

Figure 1:
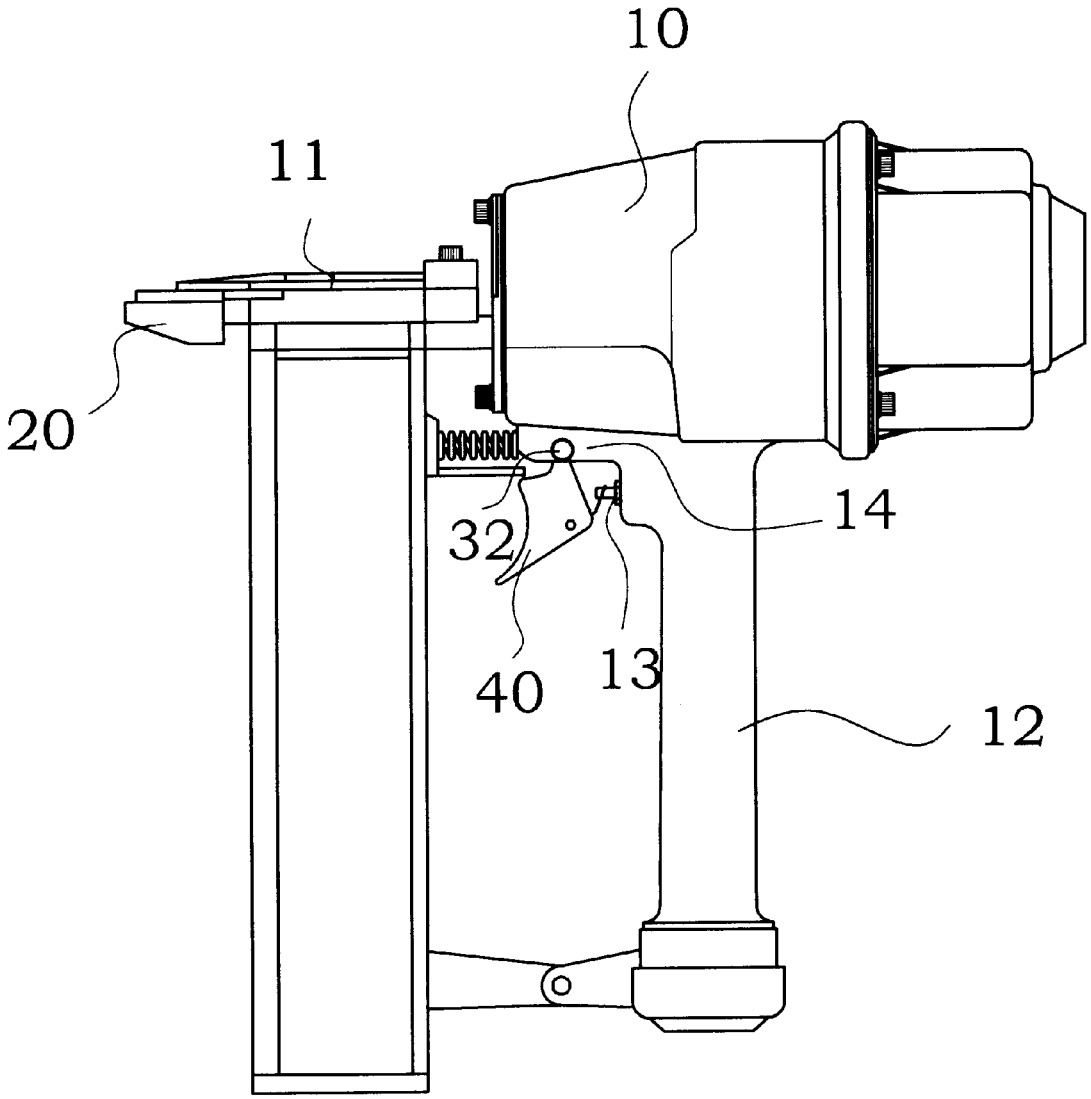
FIG. 1 is plain view of an air nailing gun constructed according to the first embodiment of the present invention.
Figure 2:
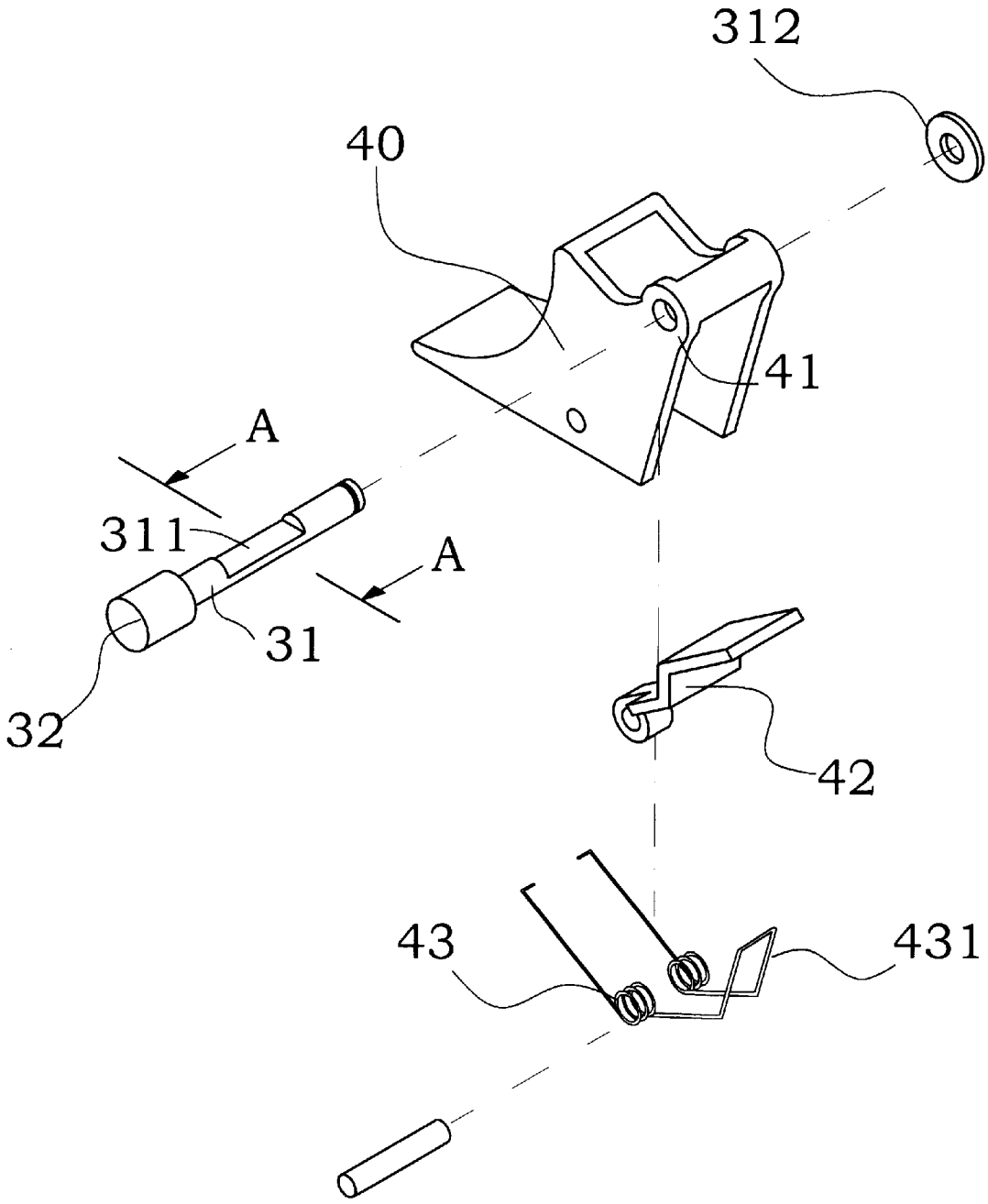
FIG. 2 is an exploded view of a part of the single/continuous dual firing mode trigger structure according to the present invention.
Figure 3:
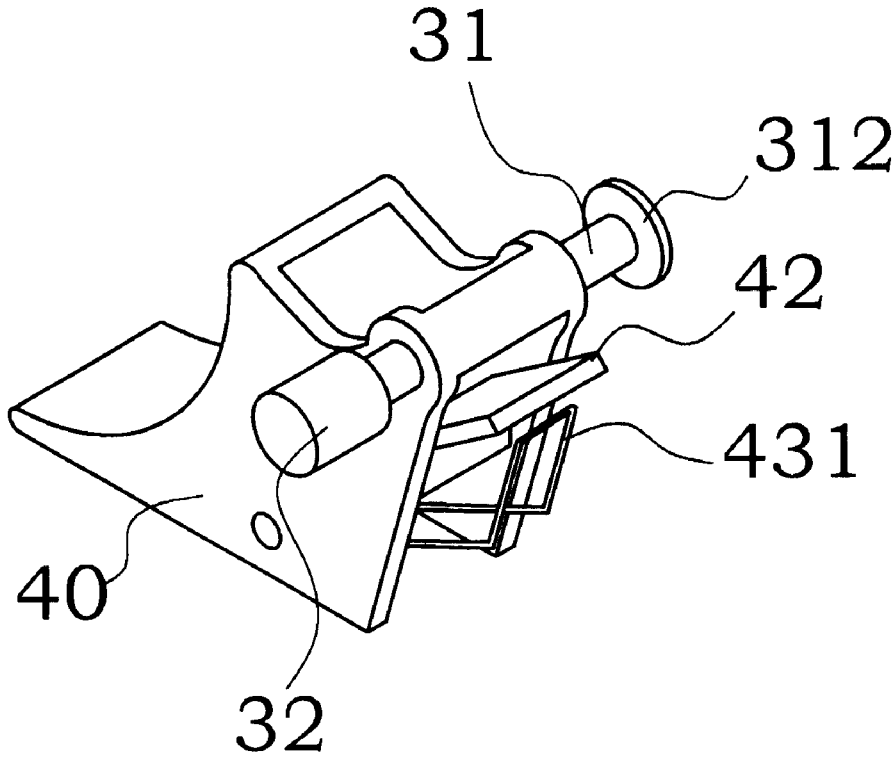
FIG. 3 is an assembly view of FIG. 2.

Referring to FIG. 1, a single/continuous dual firing mode trigger structure in accordance with the present invention the first embodiment of the present invention is shown comprised of a gun body 10, a safety link 20, a switching mechanism, and a trigger assembly 40.

Figure 4:
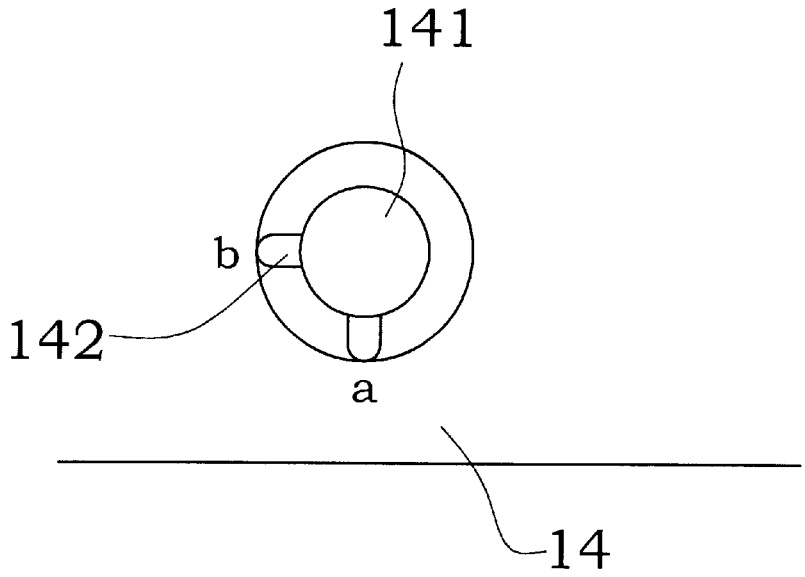
FIG. 4 is a cross-sectional view of the trigger holder showing the relation between the pivot hole and the locating notches according to the first embodiment of the present invention.
Figure 5:
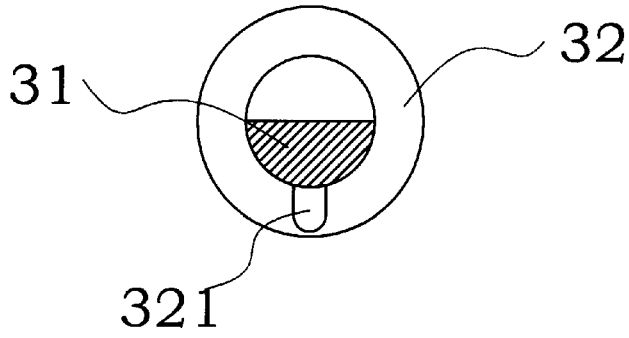
FIG. 5 is a cross-sectional view of the switching mechanism according to the first embodiment of the present invention.

Referring to FIGS. from 2 through 6A and FIG. 1 again, the gun body 10 comprises a forwardly extended front muzzle 11, a downwardly extended bottom handle 12, a firing valve 13 disposed in the front top side of the bottom handle 12, a trigger holder 14 provided at a front upper side relative to the firing valve 13, a pivot hole 141 transversely extended through the trigger holder 14, and two locating notches 142 provided in the trigger holder 14 and respectively radially extended from the pivot hole 141 at right angles (see FIG. 4). The safety link 20 is axially slidably mounted in the front side of the front muzzle 11 of the gun body 10, having a curved rear end 21 extended to the inside of the trigger holder 14 (see also FIG. 6A). The aforesaid switching mechanism comprises a pivot axle 31, and a knob 32 fixedly located on one end of the pivot axle 31. The knob 32 has a protruded engagement portion 321 disposed in the connecting area between the pivot axle 31 and the knob 32. The pivot axle 31 has a longitudinal cut plane 311 in the periphery. The remote end of the pivot axle 31 (the end remote from the knob 32) is mounted with a spring washer 312. The trigger assembly 40 comprises a main trigger member 41 pivoted to the pivot axle 31, a supplementary trigger member 42 pivoted to the inside of the main trigger member 41 by a pivot pin, and a torsional spring 43 mounted on the pivot pin. The torsional spring 43 has a middle saddle 431 coupled to the firing valve 13. The two distal ends of the torsional spring 43 are stopped against the inside wall of the main trigger member 41. When the trigger assembly 40 triggered, the torsional spring 43 imparts a spring force to return the trigger assembly 40 to its former position. The firing valve 13 is of a two-step firing design that does not fire the nailing gun when forced to the first step position, and achieves a firing action when forced further to the second step position. When fired, the firing valve 13 must be fully released so that air pressure can be charged again for a next firing operation.

The user can pull the knob 32 and the pivot axle 31 outwards at a distance and then rotate the knob 32 and the pivot axle 31, enabling the protruded engagement portion 321 to be aimed at one locating notch 142 of the trigger holder 14. When the user released the hand from the knob 32 at this time, the spring washer 312 imparts a spring force to return the axle knob 31, thereby causing the protruded engagement portion 321 to be engaged into the selected locating notch 142 of the trigger holder 14.

Before pressing the safety link 20 on the surface of the workpiece, the top end of the supplementary trigger member 42 is forced into contact with the periphery of the pivot axle 32. When triggering the main trigger member 41 at this time, the firing valve 13 is moved to the first step position without firing the nailing gun. When the user pressed the safety link 20 on the surface of the workpiece, the curved rear end 21 of the safety link 20 pushed the top end of the supplementary trigger member 42 inwards toward the firing valve 13 to move the firing valve 13 from the first step position to the second step position to fire the nailing gun.

Figure 6A:
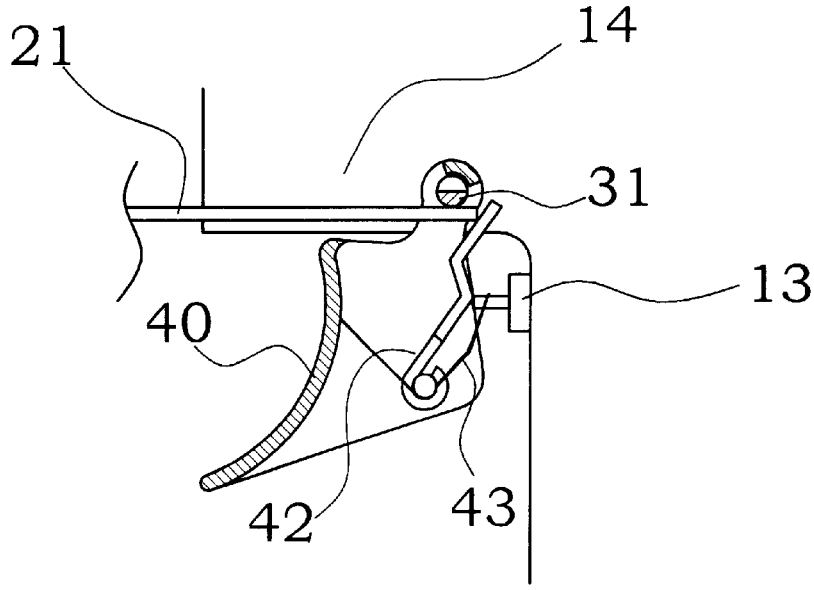
FIG. 6A is a schematic drawing showing the single firing operation of the present invention (I).
Figure 6B:
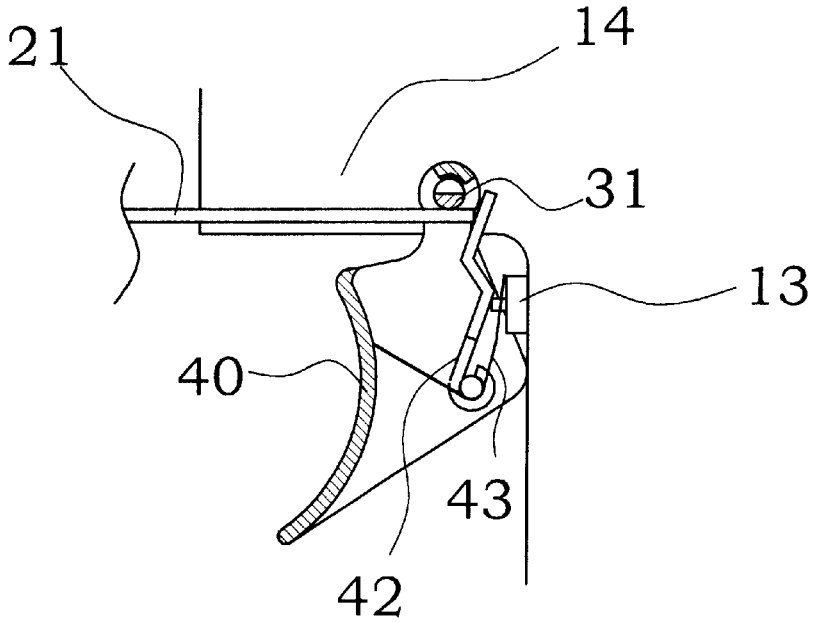
FIG. 6B is a schematic drawing showing the single firing operation of the present invention (II).
Figure 6C:
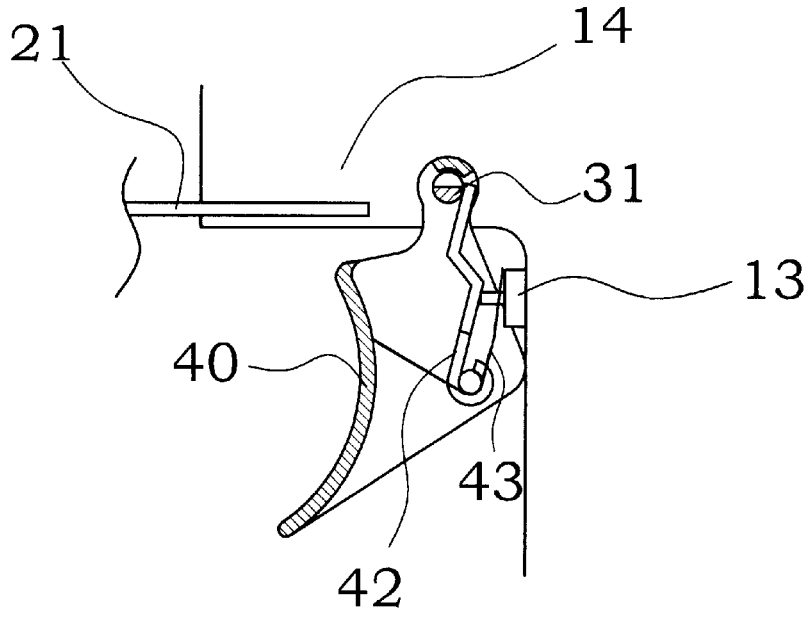
FIG. 6C is a schematic drawing showing the single firing operation of the present invention (III).

Referring to FIGS. 6A, 6B, and 6C, when the user turned the switching mechanism (the knob 32) to the single firing position to engage the protruded engagement portion 321 into the first locating notch 142 (the position referenced by "a" in FIG. 4) of the trigger holder 14, the pivot axle 31 is turned to the first position where the longitudinal cut plane 311 is kept perpendicular to the supplementary trigger member 42. When the user released the safety link 20 from the workpiece after fired, the supplementary trigger member 42 is forced by the spring force of the torsional spring 43 against the pivot shaft 31 and prohibited from releasing the firing valve 13. At this time, the user must release the main trigger member 41 so that the firing valve 13 can be released for enabling the nailing gun to be charged with air again for a next firing operation.

Figure 7:
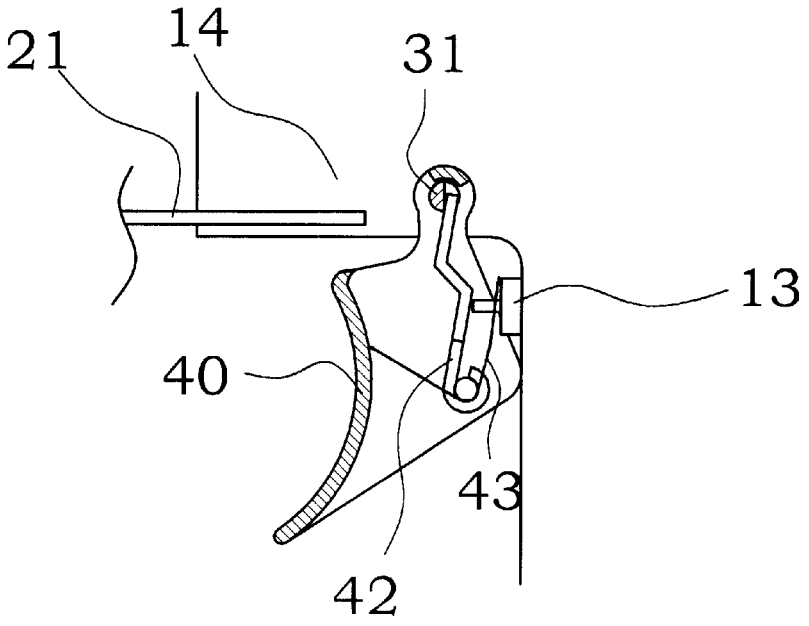
FIG. 7 is a schematic drawing showing the continuous firing operation of the present invention.

Referring to FIG. 7, when the when the user turned the switching mechanism (the knob 32) to the continuous firing position to engage the protruded engagement portion 321 into the second locating notch 142 (the position referenced by "b" in FIG. 4) of the trigger holder 14, the supplementary trigger member 42 is forced over the longitudinal cut plane 311 of the pivot shaft 31 to release the wiring valve 13, enabling the nailing gun to be charged with air again for a next firing operation. When the user holding the main trigger member 42 in the triggering position and repeatedly pressing the safety link 20 against the workpiece, the nailing gun drives nails into the workpiece continuously.

By means of the effect of the longitudinal cut plane 311 of the pivot shaft 31, the user can selectively control the operation of the air nailing gun between the single firing mode and the continuous firing mode.

Figure 8:
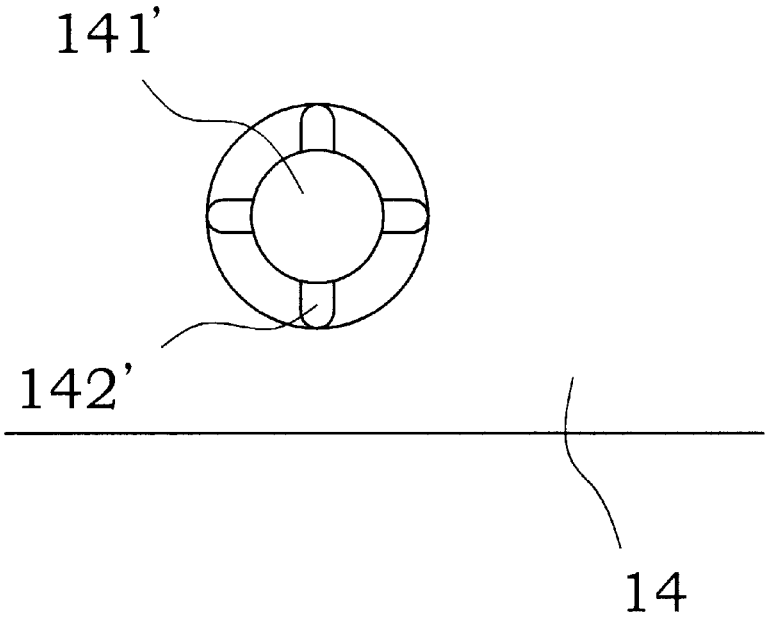
FIG. 8 is a cross-sectional view of the trigger holder showing the relation between the pivot hole and the locating notches according to the second embodiment of the present invention.
Figure 9:
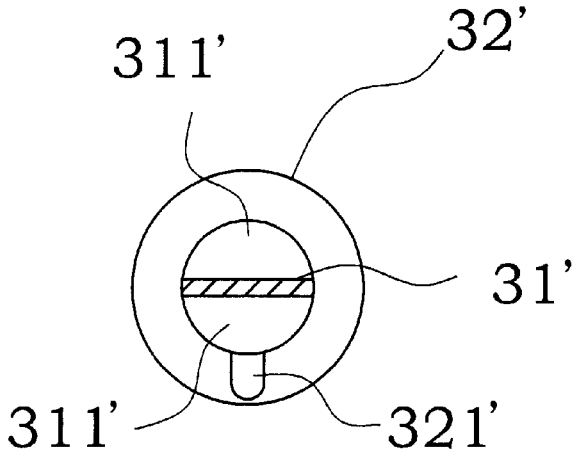
FIG. 9 is a cross-sectional view of the switching mechanism according to the second embodiment of the present invention.

FIGS. 8 and 9 show a part of the second embodiment of the present invention. According to this embodiment, there are four locating notches 142' equiangularly spaced around the pivot hole 141' of the trigger holder 14, and the pivot axle 31' has two longitudinal cut plane 311' at two opposite sides. This alternate form enables the switching mechanism to be turned between the single firing position and the continuous firing position either in the clockwise direction or the counter-clockwise direction.

A prototype of single/continuous dual firing mode trigger structure for air nailing gun has been constructed with the features of FIGS. 1~9. The single/continuous dual firing mode trigger structure for air nailing gun functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A single/continuous dual firing mode trigger structure installed in an air nailing gun and adapted to fire said nailing gun, comprising: gun body having a handle, a firing valve installed in said handle, said firing valve being of a two-step firing design that does not fire said air nailing gun when forced to a first step position, and achieves a firing action when forced further to a second step position; a trigger holder, said trigger holder having a pivot hole; a safety link axially slidably mounted in muzzle of said gun body, said safety link having a curved rear end extended to the inside of said trigger holder; a trigger assembly pivoted to said pivot hole of said trigger holder and adapted to drive said firing valve to fire said air nailing gun;

Wherein said trigger assembly comprises a main trigger member pivoted to the pivot hole of said trigger holder, a pivot shaft, which pivots said main trigger member to the pivot hole of said trigger holder, said pivot shaft having a longitudinal cut plane, and a supplementary trigger member, said supplementary trigger member having a tail movably pivoted to the inside of said main trigger member and a head to be stopped at said pivot shaft.

2. The single/continuous dual firing mode trigger_ structure as claimed in claim 1, wherein said pivot shaft has one end fixedly provided with a knob and an opposite end mounted with a spring washer.

3. The single/continuous dual firing mode trigger_ structure as claimed in claim 2, wherein said knob has a protruded engagement portion disposed in the connecting area between said pivot axle and said knob; said trigger holder has a first locating notch and a second locating notch radially extended from said pivot hole at two sides for receiving said protruded engagement portion of said knob selectively to control the direction of the longitudinal cut plane of said pivot shaft.

4. The single/continuous dual firing mode trigger_ structure as claimed in claim 3, wherein when pulling said pivot shaft outwards from said main trigger member and rotating said pivot shaft to let said protruded engagement portion of said knob be engaged into said first locating notch, the head of said supplementary trigger member is stopped at said pivot shaft and prohibited from passing over said pivot shaft, and said firing valve is moved to said first step position when pressing said main trigger member at this time.

5. The single/continuous dual firing mode trigger_ structure as claimed in claim 3, wherein when pulling said pivot shaft outwards from said main trigger member and rotating said pivot shaft to the position to let said protruded engagement portion of said knob be engaged into said first locating notch, the head of said supplementary trigger member is stopped at said pivot shaft and prohibited from passing over said pivot shaft, and said firing valve is moved to said first step position and then said step position to fire said air nailing gun when pressing said safety link against the workpiece and triggering said main trigger member at this time.

6. The single/continuous dual firing mode trigger_ structure as claimed in claim 3, wherein when pulling said pivot shaft outwards from said main trigger member and rotating said pivot shaft to let said protruded engagement portion of said knob be engaged into said second locating notch and said longitudinal cut plane of said pivot be aimed at said supplementary trigger member, the head of said supplementary trigger member is stopped at said longitudinal cut plane of said pivot shaft and said supplementary trigger member is prohibited from touching said firing valve and said air nailing gun is prohibited from firing when triggering said main trigger member at this time.

7. The single/continuous dual firing mode trigger_ structure as claimed in claim 3, wherein when pulling said pivot shaft outwards from said main trigger member and rotating said pivot shaft to let said protruded engagement portion of said knob be engaged into said second locating notch and said longitudinal cut plane of said pivot be aimed at said supplementary trigger member, the head of said supplementary trigger member is stopped at said longitudinal cut plane of said pivot shaft and said firing valve is driven to continuously fire said air nailing gun when holding said main trigger member in the triggered position and continuously pressing said safety link against the workpiece and releasing said safety link from the workpiece.

8. The single/continuous dual firing mode trigger_ structure as claimed in claim 2, wherein said knob has a protruded engagement portion disposed in the connecting area between said pivot axle and said knob; said trigger holder has a plurality of locating notches radially extended from and equiangularly spaced around said pivot hole for receiving said protruded engagement portion of said knob selectively to control the direction of the longitudinal cut plane of said pivot shaft.

9. The single/continuous dual firing mode trigger_ structure as claimed in claim 1, wherein said pivot shaft has two longitudinal cut planes at two opposite sides.

10. The single/continuous dual firing mode trigger structure as claimed in claim 1, wherein said trigger assembly further comprises a to4rsional spring adapted to return said main trigger member and said supplementary trigger member after each triggering action.

* * * * *